United States Patent [19]

Hryhorczuk

[11] 3,956,691

[45] May 11, 1976

[54] MULTIPLE FUNCTION TESTING DEVICE FOR SIMULTANEOUS TESTING OF FUNCTIONS OF AN ENGINE

[75] Inventor: Dmytro Hryhorczuk, Chicago, Ill.

[73] Assignee: Orbit Laboratories, Inc., Chicago, Ill.

[22] Filed: Mar. 27, 1975

[21] Appl. No.: 562,863

Related U.S. Application Data

[63] Continuation of Ser. No. 437,248, Jan. 28, 1974, abandoned.

[52] U.S. Cl. ..... 324/15

[51] Int. Cl.[2] ..... F02P 17/00

[58] Field of Search ..... 324/15, 16 R, 16 T

[56] References Cited

UNITED STATES PATENTS

| | | | |
|---|---|---|---|
| 2,908,859 | 10/1959 | Moehring | 324/16 R |
| 3,158,804 | 11/1964 | Weissert | 324/15 |
| 3,383,592 | 5/1968 | Williamson | 324/15 |
| 3,573,609 | 4/1971 | Vaher | 324/16 T |
| 3,693,073 | 9/1972 | Colette | 324/16 R |
| 3,781,656 | 12/1973 | Glew | 324/16 T |

*Primary Examiner*—Stanley T. Krawczewicz
*Attorney, Agent, or Firm*—Silverman & Cass, Ltd.

[57] ABSTRACT

A multiple function testing device has four circuits for measuring various functions of an internal combustion engine. The circuits are a cam dwell angle measuring circuit, a tachometer circuit, a voltmeter circuit and a timing light. The device is designed such that the cam dwell measuring circuit, tachometer circuit and voltmeter circuit use a common meter. Any one of these three circuits may be selectively operated simultaneously with operation of the timing light for simultaneous measurement of timing and one of dwell angle, R.P.M. or voltage.

15 Claims, 1 Drawing Figure

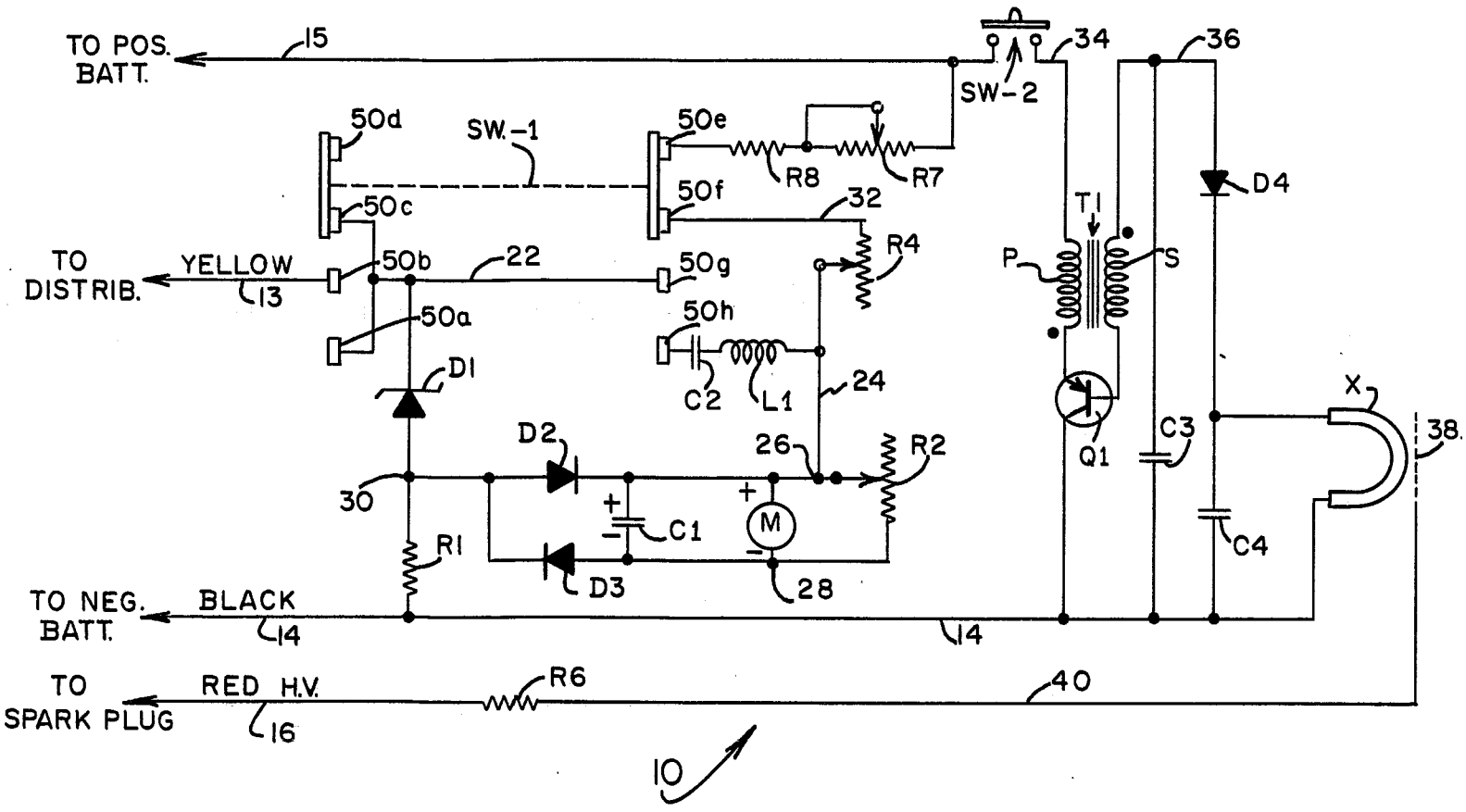
38
X
D4
C4
36
C3
S
T1
Q1
34
P
SW-2
40
14
R7
R4
R2
32
24
R8
26
28
M
L1
50e
50f
50g
50h
C2
C1
D3
D2
R6
SW.-1
22
D1
R1
50a
50b
50c
50d
30
15
YELLOW
13
BLACK
14
RED H.V.
16
TO POS. BATT.
TO DISTRIB.
TO NEG. BATT.
TO SPARK PLUG
10

MULTIPLE FUNCTION TESTING DEVICE FOR SIMULTANEOUS TESTING OF FUNCTIONS OF AN ENGINE

This is a continuation of application Ser. No. 437,248, filed Jan. 28, 1974, and now abandoned.

BACKGROUND OF THE INVENTION

The invention relates to devices which are used for testing internal combustion engines. The primary functions which are capable of being executed by the device of the invention are to operate as a timing light, as a tachometer, as a cam dwell angle meter and as a voltmeter.

The primary quality of the invention is its simplicity and its totally foolproof character.

Multiple function testing devices for internal combustion engines have been in use for a number of years. One such device which has enjoyed great success is shown and described in U.S. Pat. No. 3,693,073, and is assigned to the same assignee as this application. The device described in the aforementioned patent operated as a timing light, as a tachometer and as a cam dwell angle meter. In order to operate as a tachometer or as a cam dwell angle meter a test lead was connected to the distributor of the engine. In order to operate as a timing light, the test lead was connected to the positive terminal of the engine battery. A switch then selectively connected the test lead to the appropriate one of the timing light circuitry, tachometer circuitry and cam dwell angle, measuring circuitry in order to perform the necessary testing.

In many instances it is desirable to be able to test and adjust the timing of an internal combustion engine while simultaneously testing and adjusting either the dwell or engine R.P.M. It is additionally desirable to be able to test voltage at various points in the engine in order to locate various problems which can be present in the engine. It is particularly important to be able to check battery voltage during engine operation in order to check proper operation of the engine regulator and generator. Of course, if these checks are made, they should be made at particular settings of engine R.P.M. because of the instrumentationship between R.P.M. and generator and regulator voltage.

Previous devices, including the device referenced in the above noted patent, required switching test leads between at least two engine points in order to perform certain ones of the functions which could be performed. No devices known are capable of simultaneously performing at least two of the functions in order to simultaneously perform a number of engine tests which are best performed simultaneously. Although a number of devices may be attached to an engine in order to perform all functions simultaneously, useage of a number of devices simultaneously is cumbersome and expensive, and in many cases quite difficult because of the number of adjustments which must be made to each of the devices employed.

SUMMARY OF THE INVENTION

In practicing the invention there is provided an apparatus for testing an internal combustion engine by measuring engine timing, cam dwell and revolutions per minute. The apparatus includes cam dwell measuring circuitry and tachometer circuitry each having an input terminal for connection to the distributor of an engine and an output terminal for connection to the engine ground. A single meter circuit is connected between both of the cam dwell measuring circuitry and the tachometer circuitry and the output terminal. The cam dwell measuring circuitry and the tachometer circuitry are connected within the apparatus to operate substantially independently of each other.

An engine timing light is also provided and has a first terminal for connection to the positive terminal of the battery, a second terminal for a connection to a spark plug and a third terminal for connection to the output terminal. One of the cam dwell measuring circuitry on the tachometer circuitry is selectively operable simultaneous with operation of the timing light for simultaneous measurement of timing and one of the dwell angle and R.P.M. in a single apparatus. The apparatus of this invention can be a portable apparatus which may be hand held while testing the engine. The appatatus additionally can include voltmeter circuitry which is selectively operable, as are the tachometer circuitry and the cam dwell measuring circuitry, simultaneous with the timing light for allowing simultaneous measurement of engine timing and voltage.

BRIEF DESCRIPTION OF THE DRAWING

The single FIGURE is a circuit diagram of an instrument which is constructed according to the invention and all contained within a single case.

DESCRIPTION OF THE PREFERRED EMBODIMENT

The circuit diagram illustrates the testing device of this invention which is designated generally by the reference numeral 10. Certain components shown in the circuit diagram are identical to those shown in U.S. Pat. No. 3,693,073 and are given the same reference numbers as are shown in the above noted U.S. patent.

Referring to the diagram, four electrical test leads are provided, these being the leads 13, 14, 15 and 16 suitably colored for identification as indicated in the diagram. The lead 13 is adapted to be connected to the primary terminal of the distributor of the internal combustion engine; the lead 14 is adapted to be connected to the negative terminal of the battery; the lead 16 is a high tension lead adapted to be connected to a spark plug wire, typically that of spark plug number one; and the lead 15 is adapted to be connected to the positive terminal of the battery. The lead 13 extends to one contact **50*b* of a two pole three position switch SW1. Switch SW1 is adapted to be manually moved to any one of the three positions, depending on the use to which the instrument is being put. In the first position, contacts 50*a* and 50*b* are connected on the first pole and 50*g* and 50*h* are connected on the second pole. In the second position 50*b* and 50*c* are connected on the first pole and 50*g* and 50*h* are connected on the second pole. In the third position, 50*c* and 50*d* are connected on the first pole, and 50*e* and 50*f* are connected on the second pole. Contacts 50*a* and 50*c* on the first pole are connected via conductor 22 to contact 50*g* on the second pole. Between the conductor 22 and lead 14 there is connected a zener diode D1 in series with the resistor R1.**

Considering first the switch SW1 in its first position for allowing operation as a tachometer, lead 13, connected to the distributor of the engine, is connected through contacts **50*a* and 50*b* of SW1 to conductor 22. Conductor 22 is connected to contact 50*g* of the second pole of SW1,** and through the switch to contact 50*h* of the second pole of SW1. Contact 50*h* is connected through a capacitor C2 and a series inductor L1 to the lead 24 which is the positive terminal 26 of the ammeter M. A capacitor C1 is connected from the positive terminal 26 across the meter M to the negative terminal 28. A variable resistor R2 is also connected across the meter M. The diodes D2 and D3 are connected from the respective terminals 26 and 28 to the point 30 between the zener diode D1 and the resistor R1. They are poled as shown in the diagram.

Considering switch SW1 in its second position for allowing use of the apparatus as a cam dwell angle meter, lead 13 is connected through contacts 50*b* and 50*c* in the first pole of SW1 to conductor 22. Conductor 22 is connected as before to contact 50*g* on the second pole of switch SW1. In the second position, contact 50*g* is connected to contact 50*f* of the second pole of switch SW1. Contact 50*f* is connected by the lead 32 to the variable resistor R4 and through the wiper of that resistor to the lead 24.

Considering next switch SW1 in its third position for allowing operation as a voltmeter, lead 15, connected to the positive battery terminal, is connected through the series combination of variable resistor R7 and resistor R8 to contact 50*e* of the second pole of switch SW1. With switch SW1 in the first position, contact 50*e* is connected to contact 50*f*. Contact 50*f* as noted above is connected by the lead 32 to the variable resistor R4 and through the wiper of that resistor to the lead 24.

Positive battery lead 15, in addition to being connected to variable resistor R7 connects through momentary contact switch SW2 and lead 34 to the primary winding P of transformer T1. The primary winding P connects through the emitter-collector electrodes of the transistor Q1 to the lead 14. The secondary winding S of the transformer T1 is connected at its bottom end to the base of the transistor Q1, its top end being connected to the lead 36. The lead 36 is connected in series with the diode D4 to one terminal of the xenon gaseous discharge lamp X, the other terminal of the lamp X being connected to the lead 14. The capacitor C3 is connected across the leads 36 and 14, while the capacitor C4 is connected across the terminals of the xenon lamp X. An external capacitively coupled electrode 38 for aiding in the ignition of the lamp X is connected by the lead 40 through the series resistor R6 to the lead 16.

When it is desired to utilize the instrument 10 as a timing light, the xenon lamp is flashed synchronously with one of the spark plugs. This stroboscopic light is then directed against the timing marks of the flywheel or the harmonic balancer, depending upon the kind of internal combustion engine that is being tested. The distributor locking screw is loosened and the distributor can be rotated manually until the position of the timing marks is in accordance with the manufacturer's specification, or as desired. At this point the distributor is locked in place.

The circuit which is used for this activity is that which is put into play by depressing the momentary contact switch SW2. The transformer T1 and the transistor Q1 together form an oscillator together with the capacitor C3 to provide a signal for charging up the storage capacitor C4. In the practical circuit, the transformer T1 was an economical radio loudspeaker output transformer reversed so that its original output winding was the primary winding P and its original input winding was the secondary winding S. The connection to the transistor Q1 enables the transistor to switch the current on and off in the primary winding P giving the desired oscillation. The constants of the circuit were chosen to provide a frequency of about 1500 hertz. The excitation for the transistor Q1 is derived from the secondary winding S which is connected to the base with phasing such that the currents are in opposition. The capacitor C3 provides a low impedance return path for the 1500 hertz oscillatory signal.

The signal produced by the oscillator is rectified by the diode D4 and charges up the condenser C4 to a high voltage, say of the order of 300 to 400 volts, which is just insufficient to ionize the xenon lamp X. The connections of the circuit are made with the lead 15 connected to the positive terminal of the battery, the lead 14 is connected to the negative terminal of the battery, while the lead 16 is connected to a spark plug wire. Under these conditions, each time that the spark plug fires, there will be a high voltage field produced between the electrode 38 and the lamp X, which together with the voltage already existing due to the charge on the capacitor C4 is sufficient to discharge the lamp X. At this point, the charge on the condenser C4 is dumped into the lamp resulting in a high intensity gaseous discharge. The resistor R6 in series with the lead 16 provides a voltage divider action acting together with the distributed capacity of the lead. This reduces the steepness of the spark plug pulse to prevent arc-over and to reduce the insulation requirements of the leads 16 and 40.

Simultaneously with the use of instrument 10 as a timing light, the instrument 10 can be used as a tachometer, a cam dwell angle measuring meter, or a voltmeter. Although the high tension lead 16 is not used for purposes of measuring voltage, cam dwell angle or R.P.M. this lead should be connected to the spark plug in order to allow simultaneous testing of timing and one of the other three functions.

When used for dwell angle measuring, switch SW1 is moved to the second position so that lead 13 is connected to terminal 50 via contacts on the first and second pole of switch SW1 and conductor 22.

Contact 50f of switch SW1 effectively connects the resistor R4 in series with the meter M and the resistor R1. The resistor R1 has a voltage developed in it which is limited by the zener diode D1 so that in effect there is an ohmmeter circuit. When the points of the distributor are open, the voltage is zero, and when the points are closed, the voltage is maximum. The meter M is adjusted to read full scale for the condition of the points being closed by adjusting the resistor R4. The resistor R2 is a shunt to compensate for the type of meter used. With the points opening and closing, the meter M will assume an intermediate position which is a function of the percentage of time that the points are closed, which in effect is the dwell time. The meter has a scale which is calibrated to give this time, and the adjustment can be made to change it simply by adjusting the breaker points.

When used as a tachometer for R.P.M. measurements switch SW1 is moved to its first position such that lead 13 is coupled to contact 50h of the second pole of switch SW1 via contacts on the first and second poles of switch SW1 and conductor 22.

Contact 50h of switch SW1 connects the inductor L1 and condenser C2 in series with the meter M. The inductor L1 and condenser C2 function as a differentiator, to generate a series of pulses of substantially fixed amplitude and width, depending upon the time constant of the LC combination. These pulses are positive and negative, occurring when the points open and close. The negative signals are eliminated by the arrangement of the diodes D2 and D3 and the positive pulses are integrated by the high capacitance capacitor C1 which is across the meter M. This produces an average d.c. value which is read by the meter. The greater the number of pulses, the higher the current measured by the meter. The meter is thus calibrated in terms of R.P.M. with different scales for the different numbers of cylinders.

When operated as a voltmeter for measuring voltage, switch SW1 is moved to its third position. In the third position, lead 15 and the series combination of resistors R7 and R8 are connected through contacts 50e and 50f of the second pole of switch SW1 to the resistor R4. This effectively connects the series combination of resistors R7, R8, and R4 in series with the meter M1 and the resistor R1. The variable resistor R7 is adjusted such that the meter M will read full scale for the condition of the battery being charged to its maximum potential. Any decrease from this maximum potential can therefore be measured by the voltmeter circuit so that battery condition or charging voltage as supplied by the generator or alternator to the battery can be tested.

As can be seen testing of an engine by measurement of cam dwell, R.P.M. or voltage can be accomplished simultaneously with testing of the engine timing via selection of one of the three positions of switch SW1 and depression of momentary contact switch SW2. No leads need be moved, once the leads are initially connected to the engine, in order to make any of the above noted tests. Furthermore, the entire apparatus is designed to be inserted in a single hand-held portable case which can be conveniently held such that the meter M may be read while simultaneously directing the xenon lamp X as the flywheel or harmonic balancer of the engine for timing the engine.

Some typical values for a practical circuit are as follows:

R1 — 330 ohms
R2 — 10K ohms for a meter having 1,000 ohms resistance.
1 K ohms for a meter having 100 ohms resistance.
R4 — 10K ohms
R6 — 330K ohms
R7 — 10K ohms
R8 — 330 ohms
C1 — 160 microfarads
C2 — 1 microfarad
C3 — .01 microfarad
C4 — 2.2 microfarads
L1 — 75 milihenries The zener diode had a break-down voltage of 8.2 volts.

What it is desired to secure by Letters Patent of the United States is:

1. An apparatus for testing an internal combustion engine by measuring distributor timing, cam dwell revolutions per minute and voltage functions, said apparatus including in combination:

a single meter circuit including an input terminal and an output terminal adapted to be connected to a first terminal of the engine battery;

a cam dwell measuring means and a tachometer means, both said means having a common input terminal for connection to a distributor of an engine and an output terminal for connection to said meter circuit input terminal;

said cam dwell measuring means and said tachometer means being connected within said apparatus to operate supstantially independently of each other;

an engine timing light means having a first terminal for connection to a second terminal of said battery, a second terminal for connection to a spark plug, and a third terminal for connection to said meter circuit output terminal;

and a voltmeter means including a variable resistor having a resistance range selected to provide full scale meter deflection for the condition of a battery being charged to its maximum potential coupled between said timing light means first terminal and said meter circuit input terminal, one of said cam dwell measuring means, said tachometer means and said voltmeter means being selectively operable simultaneous with operation of said timing light means for simultaneous measurement of engine timing and one of cam dwell, revolutions per minute and voltage.

2. The apparatus of claim 1 wherein said cam dwell measuring means includes, first circuit means connected to said meter circuit means to supply thereto a signal proportional to the percentage of time that the engine breaker points are open circuit, said tachometer means includes second circuit means being connected within said apparatus to operate substantially independent of each other, and said timing light means includes an engine timing light circuit having said first terminal for connection to said second battery terminal for supplying exclusive d.c. power to said timing light circuit, a lamp to be periodically ignited by said timing light circuit, first coupling means coupling said lamp across said first and output terminals and for applying to said lamp pulsed d.c. energy of relatively high frequency and of a value below the ignition point of said lamp, second coupling means, including voltage dropping means for protection of the entire apparatus, connected to said second terminal and capacitively coupled to said lamp for supplying pulse energy of sufficient magnitude in combination with said pulsed d.c. to ignite said lamp in synchronism with the firing of the spark plug.

3. The apparatus of claim 1 wherein said voltmeter means includes resistance means coupled in series between said timing light means first terminal and said meter circuit input terminal.

4. The apparatus of claim 1 wherein said cam dwell means is connected between said voltmeter means resistance means and said meter circuit input terminal.

5. The apparatus of claim 1 wherein said timing light means includes, timing light switch means coupled to said first terminal for selectively operating said timing light means simultaneous with operation of one of said cam dwell measuring means and said tachometer means.

6. The apparatus of claim 1 further including switching means coupled to said cam dwell measuring means and said tachometer means and having a connection terminal for connection to the distributor of an engine, said switching means coupling one of said cam dwell measuring means and said tachometer means to said distributor means for selectively operating the same simultaneous with operation of said timing light means.

7. The apparatus of claim 6 wherein said voltmeter means has an input terminal coupled to said switching means, said switching means coupling one of said cam dwell measuring means and said tachometer means to a distributor means and said voltmeter means to the positive terminal of a battery for selectively operating the same simultaneous with operation of said timing light means.

8. The apparatus of claim 7 wherein said timing light means includes timing light switch means coupled to said first terminal for selectively operating said timing light means simultaneous with operation of one of said cam dwell measuring means, tachometer means and voltmeter means.

9. The apparatus of claim 7 wherein said voltmeter means includes resistance means coupled in series between said timing light means first terminal and said meter circuit input terminal.

10. The apparatus of claim 9 wherein said switching means connects said tachometer means between said voltmeter means resistance means and said meter circuit input terminal.

11. The apparatus of claim 6 wherein said cam dwell measuring means includes, first circuit means connected to said meter circuit means to supply thereto a signal proportional to the percentage of time that the engine breaker points are an open circuit, said tachometer means includes second circuit means connected to said meter circuit means to supply thereto a signal proportional to the number of times that the breaker points open per unit time, said first and second circuit means being connected within said apparatus to operate substantially independent of each other, and said engine timing light means includes an engine timing light circuit having said first terminal for connection to the positive battery terminal of an engine for supplying exclusive d.c. power to said timing light circuit, said second terminal for connection to a spark plug of an engine, a lamp adapted to be periodically ignited by said timing light circuit, first coupling means coupling means coupling said lamp across said first and output terminals and for applying to said lamp pulsed d.c. energy of relatively high frequency and of a value below the ignition point of said lamp, second coupling means including voltage dropping means for protection of the entire apparatus connected to said second terminal and capacitively coupled to said lamp for supplying pulsed energy of sufficient magnitude in combination with said pulsed d.c. to ignite said lamp in synchronism with the firing of a spark plug.

12. The apparatus of claim 11 wherein said first coupling means of said timing light circuit includes an oscillator consisting of a transformer with primary and secondary windings and an electronic switch connected to both windings and turned on and off by pulsed d.c. signals from said secondary winding.

13. The apparatus of claim 11 wherein said first circuit means of said cam dwell measuring means comprises:

a resistance means in series between said input terminal and said meter circuit input terminal;

and a voltage regulator means connected between said switching means connection terminal and said output terminal, said second circuit means of said tachometer means including a differentiating circuit connected to said input terminal and said meter circuit input terminal.

14. The apparatus of claim 13 wherein said switching means switches said voltmeter resistance means and said cam dwell measuring means resistive means in series with said one side of said meter circuit means.

15. An apparatus for testing an internal combustion engine by measuring distributor timing, cam dwell, revolutions per minute, and voltage functions, comprising:

a gang switch incorporating first and second slidable bars in combination with first and second sets of four contacts, said bars adapted to interconnect adjacent contacts sequentially;

means to electrically interconnect said second and fourth contacts of said first set of contacts to said third contact of said second set of contacts;

means to connect said third contact of said first set of contacts to the distributor of said internal combustion engine;

an ammeter including negative and positive inputs;

a first variable resistance connected in parallel with said ammeter;

a capacitor connected in parallel with said ammeter;

a first diode including a cathode electrically connected to said ammeter positive input;

a second diode including a cathode connected to the anode of said first diode, and an anode connected to said negative meter input;

a zener diode interconnected between said common electrical connection of said first and second diodes and said second and fourth contacts of said first gang of contacts;

a first electrical junction adapted to be connected to a first terminal of the battery of said internal combustion engine;

a resistor interconnected between said first electrical junction and the electrical interconnection between said zener diode and said first and second diodes;

a series LC circuit interconnected between said fourth contact of said second group of contacts and said meter positive input;

a second variable resistance interconnected between said second contact of said second group of contacts and said meter positive input;

a second electrical junction adapted to be electrically connected to a second terminal of said internal combustion engine battery;

a third variable resistance interconnected between said first contact of said second group of contacts and said second electrical junction;

a transformer including a primary and secondary winding;

a single pull single throw switch interconnected between said primary winding and said second electrical junction;

a transistor interconnecting said primary winding to said first electrical junction via its emitter and collector;

said transistor including a base electrically connected to said transformer secondary;

a timing light including a gas discharge tube electrically connected across said transformer secondary to said first electrical junction and a capacitively coupled electrode for triggering a discharge in said tube;

and means to couple said electrode to a spark plug of said internal combustion engine.

* * * * *